United States Patent [19]

Kienzl

[11] 4,280,385

[45] Jul. 28, 1981

[54] APPARATUS FOR CUTTING FOODSTUFFS OR THE LIKE

[75] Inventor: Arnold Kienzl, Heidenheim, Fed. Rep. of Germany

[73] Assignee: Holac-Maschinenbau GmbH, Heidenheim, Fed. Rep. of Germany

[21] Appl. No.: 1,389

[22] Filed: Jan. 5, 1979

[30] Foreign Application Priority Data

Feb. 17, 1978 [DE] Fed. Rep. of Germany ... 7804766[U]

[51] Int. Cl.[3] ..... B26D 1/02; B26D 7/06

[52] U.S. Cl. ..... 83/404.3; 83/437; 83/444

[58] Field of Search ..... 83/404.3, 437, 856, 83/857, 858, 407, 444

[56] References Cited

U.S. PATENT DOCUMENTS

| | | | |
|---|---|---|---|
| 792,396 | 6/1905 | Buell | 83/404.3 |
| 925,693 | 6/1909 | Goodykoontz et al. | 83/437 |
| 938,063 | 10/1909 | Kunick | 83/437 |
| 2,407,924 | 9/1946 | Garfunkel | 83/437 |
| 2,497,289 | 2/1950 | Bloomfield | 83/437 |
| 3,187,432 | 6/1965 | Cuomo | 83/407 |
| 3,490,505 | 1/1970 | Holz | 83/207 |
| 3,513,892 | 5/1970 | Genetti | 83/404.3 |

*Primary Examiner*—Frank T. Yost

*Attorney, Agent, or Firm*—Peter K. Kontler

[57] ABSTRACT

Apparatus for slicing and/or dicing bacon has an elongated U-shaped trough of stainless steel which receives pieces of bacon and wherein a pusher advances the material to be comminuted forwardly into the range of one or more knives. The trough is removably installed in the chamber of a frame which consists of cast aluminum.

7 Claims, 3 Drawing Figures

APPARATUS FOR CUTTING FOODSTUFFS OR THE LIKE

BACKGROUND OF THE INVENTION

The present invention relates to comminuting apparatus, especially to improvements in apparatus for cutting foodstuffs, such as various types of meats including bacon. The cutting may involve severing pieces of bacon to form strips or slices, subdivision of the thus obtained slices into elongated rods and/or dicing of foodstuffs, e.g., by severing the rods at regular intervals so that each rod yields a plurality of cubes.

U.S. Pat. No. 3,490,505 granted Jan. 20, 1970 to Holz discloses a cutting device wherein a pusher advances foodstuffs along an elongated path into the range of several comminuting implements including reciprocable horizontal knives, reciprocable vertical knives and a rotary dicing knife. The foodstuffs are introduced into the path from above, and the pusher thereupon advances forwardly, usually in stepwise fashion, to move the introduced foodstuffs into the range of various knives.

As a rule, the frame or support of a cutting apparatus of the above outlined character consists of cast aluminum. Such material is also used for the manufacture of that part of the support which defines the path for advancement of foodstuffs into the range of cutting implements. Apparatus which consist, or the major components of which consist, of cast aluminum are relatively inexpensive and their weight is low so that such apparatus can be readily transported to and from the locale of use. Moreover, by resorting to a casting technique, one can produce complex parts or assemblies of parts at a reasonable cost.

The results of recently completed tests in connection with the processing of foodstuffs indicate that direct contact between aluminum and certain types of foods is not desirable, especially in regions where the parts which consist of aluminum are subjected to pronounced wear. This applies for the receptacle of the aforediscussed apparatus.

Certain presently known attempts to prevent direct contact between foodstuffs (particularly meats) and aluminum include the provision of corrosion-resistant liners serving to coat those surfaces of parts made of aluminum which would come in direct contact with the processed material. The liners are permanently attached to the adjacent parts and are made of stainless steel. For example, it is already known to provide the magazine or receptacle of the aforediscussed patented apparatus with a permanently installed liner which coats the aluminum casting and thus shields the introduced material from direct contact with aluminum. A drawback of such proposal is that the coating of aluminum parts with liners of stainless steel contributes significantly to the initial cost of the apparatus. Furthermore, the application of liners cannot be carried out with such degree of precision that particles of foodstuffs cannot penetrate between the liner and the adjacent parts of the apparatus. The thus confined particles constitute breeding grounds for bacteria and cannot be removed unless the apparatus is taken apart, i.e., unless the liner is forcibly detached from the adjacent parts. This entails long interruptions of operation and reduces the output of such apparatus. Moreover, remnants of particles in the gaps (even extremely narrow gaps) between a liner and the adjacent component or components are likely to contaminate the material which is being processed, i.e., those foodstuffs which are advanced into the range of cutting implements and issue from the apparatus in the form of slices, rods and/or cubes. Thus, there exists an urgent need for apparatus which are sanitary and sufficiently inexpensive to warrant their use not only in larger but also in smaller food processing plants and/or households.

OBJECTS AND SUMMARY OF THE INVENTION

An object of the invention is to provide a novel and improved apparatus for cutting foodstuffs or the like, especially meats, in such a way that the materials to be processed cannot come in direct contact with parts which are likely to promote or cause contamination of such materials.

Another object of the invention is to provide a comminuting apparatus for bacon or the like with a novel and improved receptacle for temporary reception of foodstuffs which are about to be comminuted to form slices, rods, dice or other suitable configurations.

A further object of the invention is to provide an apparatus of the above outlined character the major part or parts of which may consist of aluminum but wherein the materials or commodities to be processed cannot contact such parts.

An additional object of the invention is to provide a wear-resistant and sanitary receptacle for foodstuffs which can be used in certain existing apparatus upon completion of minor and inexpensive alterations of such apparatus.

Another object of the invention is to provide a cutting apparatus wherein the receptacle and/or other parts are readily accessible for frequent inspection, cleaning and/or other purposes.

The invention is embodied in a comminuting apparatus, especially an apparatus for slicing and/or dicing foodstuffs (particularly meats), wherein the commodities to be comminuted are fed into and advanced lengthwise of an elongated path into the range of mobile cutting implements, such as vertically movable sets of knives, horizontally movable sets of knives, one or more rotary and/or orbiting knives and/or others.

The apparatus comprises a support which may consist of aluminum and has a chamber or socket, and an elongated receptacle which is open at both ends and has an open side (preferably the upper side) for admission of commodities into the aforementioned path which is defined by the receptacle. The receptacle is removably installed in the socket or chamber and consists of a corrosion-resistant material, preferably stainless sheet steel.

In accordance with a presently preferred embodiment, the receptacle is a substantially U-shaped elongated trough having a flat bottom panel disposed between two parallel side panels. Those portions of the side panels which are remote from the bottom panel and are adjacent to the ends of the trough are or may be connected to each other by reinforcing or stiffening webs or ribs. The front end of the properly inserted trough can abut against a holder which supports one or more knives and is secured to or forms part of the support.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
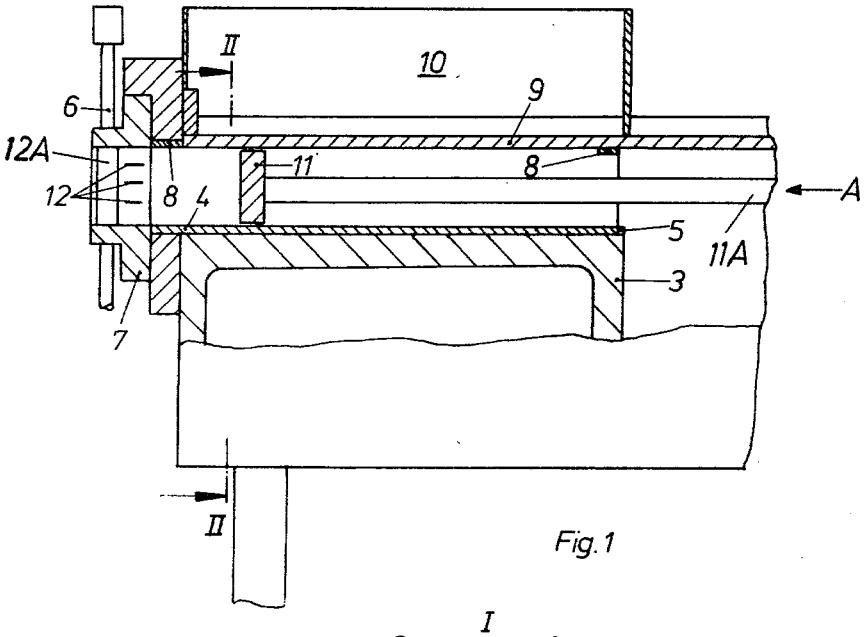
FIG. 1 is a fragmentary longitudinal vertical sectional view of a cutting apparatus which embodies the invention, the section being taken in the direction of arrows as seen from the line I—I of FIG. 2.
Figure 2:
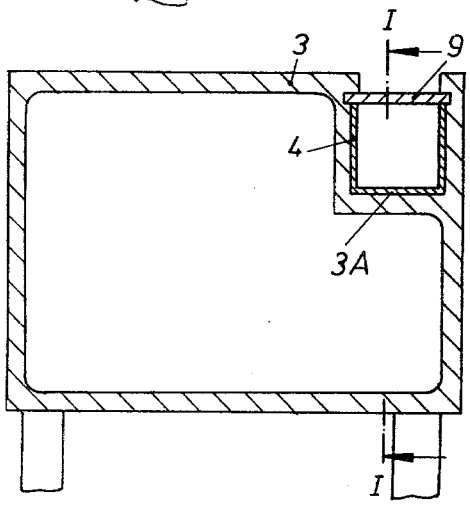
FIG. 2 is a transverse vertical sectional view as seen in the direction of arrows from the line II—II of FIG. 1.
Figure 3:
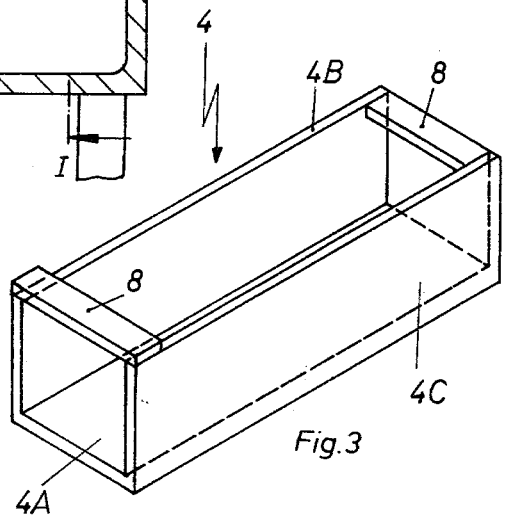
FIG. 3 is an enlarged perspective view of the receptacle.

FIGS. 1 and 2 illustrate a portion of a comminuting apparatus which can be used for slicing and/or dicing of foodstuffs, e.g., bacon. The apparatus comprises a frame or support 3 which consists of cast aluminum and is formed with a prismatic socket or chamber 3A for a removable receptacle 4 here shown as an elongated U-shaped trough which is open at both ends and is further open at one side thereof, namely, at the top. The rear side of the chamber or socket 3A (namely, the right-hand side, as viewed in FIG. 1) is open so that the trough 4 can be pushed into or retracted from the socket 3A by moving it lengthwise in or counter to the direction of arrow A.

The trough 4 comprises a horizontal bottom panel 4A which is disposed between two upwardly extending parallel side panels 4B, 4C, and two transversely extending reinforcing strips or webs 8 which connect the upper portions of the side panels 4B, 4C at the two open ends of the trough. The trough 4 consists of a corrosion-resistant material, preferably stainless sheet steel (such as remanite). When the trough 4 is fully inserted into the chamber 3A of the support 3, the rear end face of its bottom panel 4A abuts against a transverse stop 5 on the support and the front end face of the bottom panel 4A abuts against a holder 7 for a set of mobile knives or cutting implements 12 which are reciprocable at right angles to the plane of FIG. 1. Another set of knives or cutting implements 12A (only one shown in FIG. 1) is movable in the holder 7 up and down, as viewed in FIG. 1. The means for reciprocating the knives 12A is shown at 6. The holder 7 defines a passage which registers with the open left-hand end of the trough 4 to permit the material to be comminuted to advance in the direction which is indicated by the arrow A. A dicing knife (not shown) can be installed in front of the knives 12A to sever the slices or strips or slabs which are obtained as a result of comminution of the material by the knives 12 and 12A. Such dicing knife is movable in a plane which is normal to the plane of FIG. 1. Reference may be had to the aforementioned U.S. Pat. No. 3,490,505 to Holz which discloses an apparatus with two sets of reciprocable knives and a dicing knife.

The webs 8 serve to stiffen the trough 4, especially when the trough is removed from the socket 3A for the purpose of cleaning.

The apparatus which is shown in FIGS. 1 and 2 further comprises a reciprocable cover or lid 9 which is mounted in the support 3 at a level above the upper side or top of the trough 4 and is movable to and from the illustrated closed position in which it abuts against the left-hand web 8 of FIG. 1. The lid 9 constitutes the mobile bottom wall or gate of a chute 10 which serves for introduction of material to be comminuted into the elongated path defined by the trough 4. The means for advancing the material to be comminuted into the range of knives 12 comprises a pusher or plunger 11 which is reciprocable in the interior of the trough 4 by a rod 11A. The manner in which the rod 11A receives motion to move the pusher 11 between a retracted and extended positions is fully disclosed in the aforementioned patent to Holz.

When the cover 9 is retracted (in a direction to the right, as viewed in FIG. 1) and the pusher 11 is also retracted, the rear end of the bottom panel 4A can be lifted above the stop 5 and the trough 4 can be removed from the chamber 3A by moving it counter to the direction which is indicated by the arrow A. This facilitates inspection and/or cleaning of the trough 4 as well as inspection and/or cleaning or repair of other parts of the apparatus, especially the surfaces bounding the socket 3A.

An important advantage of the improved apparatus is that the trough 4 consists of a material which is highly resistant to corrosion and wear and can be readily cleaned at regular or desired intervals. Furthermore, the provision of a readily removable and corrosion-resistant sanitary trough contributes to prevention of contamination of the material to be processed (e.g., bacon) and to low cost of the apparatus since the major part of the apparatus, particularly the support 3, can be made of cast aluminum or the like.

A further advantage of the improved apparatus is that particles of foodstuffs cannot or are less likely to penetrate between the properly inserted trough 4 and the support 3 than in heretofore known apparatus wherein the support is merely provided with a permanently installed liner of corrosion-resistant material. Any particles of foodstuffs or the like which penetrate between the support 3 and the trough 4 remain in the apparatus for short periods of time because the trough 4 can be removed at frequent intervals to allow for convenient cleaning of the chamber 3A as well as of the interior and exterior of the trough 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In a comminuting apparatus, particularly for slicing and/or dicing foodstuffs, wherein the commodities to be comminuted are fed into and are advanced lengthwise along a predetermined path into the range of mobile comminuting elements, the combination of a support having a chamber; and an elongated open-ended trough consisting of stainless steel and removably installed in said chamber, said trough defining said path and having a substantially U-shaped cross-sectional outline with two upstanding side panels, a bottom panel between said side panels, an open top for admission of commodities to be comminuted, and webs connecting said side panels and extending transversely of said path adjacent to the ends of said trough and remote from said bottom panel.

2. The combination of claim 1, wherein said receptacle consists of sheet steel.

3. The combination of claim 1, wherein said comminuting elements include at least one knife adjacent to one end of said receptacle and further comprising holder means for said knife, said holder means being secured to said support and said one end of said receptacle abutting against said holder means.

4. The combination of claim 3, wherein said holder means has a passage in register with said one end of said receptacle.

5. The combination of claim 1, wherein said path is substantially horizontal.

6. The combination of claim 5, further comprising advancing means and means for moving said advancing means in and lengthwise of said receptacle.

7. The combination of claim 1, wherein said support comprises a stop for one end of said receptacle.

* * * * *